United States Patent [19]

Mullen

[11] Patent Number: 4,832,334

[45] Date of Patent: May 23, 1989

[54] APPARATUS FOR USE WITH BARBELLS

[76] Inventor: Karl I. Mullen, 7700 SW. Canyon Dr., Portland, Oreg. 97225

[21] Appl. No.: 117,999

[22] Filed: Nov. 6, 1987

[51] Int. Cl.[4] ..... A63B 13/00

[52] U.S. Cl. ..... 272/123; 272/135; 272/137; 272/141

[58] Field of Search ..... 272/68, 117, 122, 123, 272/135, 137, 141

[56] References Cited

U.S. PATENT DOCUMENTS

| | | | |
|---|---|---|---|
| 965,284 | 7/1910 | Dessetter | 272/122 X |
| 4,021,040 | 5/1977 | Inoue | 272/123 |
| 4,256,301 | 3/1981 | Goyette | 272/123 |
| 4,274,628 | 6/1981 | Hoagland | 272/123 |
| 4,564,194 | 1/1986 | Dawson | 272/123 |
| 4,623,146 | 11/1986 | Jackson | 272/123 X |

*Primary Examiner*—Richard J. Apley

*Assistant Examiner*—Robert W. Bahr

[57] ABSTRACT

A device that cooperates with free-weights to assist the weightlifters in lifting the free-weights through a portion of the exercise stroke, while still allowing the weightlifters to obtain all the benefits of using free-weights, comprised of a spring (8) and a plate (4), which cooperate to transfer an upward force to the free-weights through said portion of said excercise stroke. This invention can take many forms, including: (1) a portable, self contained bar-like device; (2) a device that attaches to the free-weight bar and to a support structure; and (3) a device that does not attach to the free-weight bar but rather comes into contact with the free-weight bar during said portion of said exercise stroke. In effect, this invention allows the weightlifter to obtain both the benefits of using variable resistance machines and the benefits of using free-weights, all in one exercise stroke.

3 Claims, 2 Drawing Sheets

APPARATUS FOR USE WITH BARBELLS

BACKGROUND

1. Field of Invention

This invention relates to free-weights used for weightlifting.

2. Description of Prior Art

This invention will allow persons (hereinafter, "weightlifters") who exercise by lifting barbells, dumbells and other weights which are not connected to chains, wires, pulleys or machines (hereinafter, "free-weights") to obtain better and more complete muscular development more quickly and efficiently.

One drawback of using free-weights is that the downward force remains constant throughout the entire exercise stroke. Because the angle, force and torque of the muscles being worked varies during the exercise stroke, there is generally a portion of the exercise stroke (the "weakpoint") through which the muscles are not able to lift as much weight as during the remaining portion of the exercise stroke (the "strongpoint"). This creates a problem as often the amount of weight weightlifters want to use through the strongpoint is too much to lift through the weakpoint, while the amount of weight the weightlifters can lift through the weakpoint is too little to sufficiently stimulate the muscles through the strongpoint.

The traditional solution is to either (1) use an amount of weight proper for the strongpoint, but stop the exercise stroke before reaching the weakpoint, or (2) perform the entire exercise stroke, but use less weight than the proper amount for the strongpoint. The problem with solution (1) is that the weightlifter is not able to exercise through the weakpoint, and therefore obtains less overall development and less or no development of any muscles that are exercised only through the weakpoint. The problem with solution (2) is that the weightlifter often must use less than the optimal weight for the strongpoint and therefore obtains less development of the muscles used through the strongpoint.

One attempt at solving the weakpoint problem has been through the use of variable resistance machines which use weights, cables, pulleys, air pressure or hydraulic. However, many weightlifters continue to use free-weights instead of machines for many reasons, including: (1) balance is developed when using free-weights, but not when using machines; (2) machines have friction generating parts which results in unwanted variation in resistance depending on the age of the machine, how well oiled it is, how tight the bolts are, etc.; (3) many weightlifters believe that free-weights develop power and strength better and more quickly than machines; (4) machines often restrict the path to be followed during an exercise motion, often to an unnatural path, resulting in less efficient muscle development, discomfort, and even injury, especially for weightlifters with very short or very long limbs; (5) many weightlifters train for contests in which free-weights are lifted, such as powerlifting or olympic weightlifting contests, and using free-weights allows them to better duplicate the contest movements; and (6) machines are usually bigger, heavier, more cumbersome, less versatile, and more expensive than free-weights.

Weightlifters would therefore benefit from an invention that would allow them to use free-weights while still properly stimulating their muscles through both the weakpoint and the strongpoint.

OBJECTS AND ADVANTAGES

This invention overcomes the weakpoint problem while still allowing the weightlifter to use free-weights instead of machines. This invention allows the weightlifter to use the optimal weight through both the weakpoint and the strongpoint, thus obtaining more complete and efficient muscular development than through the use of free-weights alone, while still allowing the weightlifter to obtain all the advantages of using free-weights instead of machines. This invention can be used for many different exercise motions, including bench press, military press, curls and squats.

One form of this invention connects directly to the free-weight bar. Another is a fully self contained bar. Another form connects to surfaces designed to come into contact with the free-weights throughout the weakpoint. These forms of this invention use a means of creating force, such as a spring or piston, to assist the weightlifter through the weakpoint but, is connected in such a manner that little or no effect is had upon the free-weights through the strongpoint. Thus, by using this invention, the weightlifter is above to exercise with free-weights and at the same time use the optimal amount of weight through both the weakpoint and the strongpoint, thereby obtaining a more complete and efficient exercise and better and more complete muscular developement. With the above object in view, reference should made to the drawings.

DETAILED DESCRIPTION OF THE PREFERRED EMBODIMENTS

Figure 1:
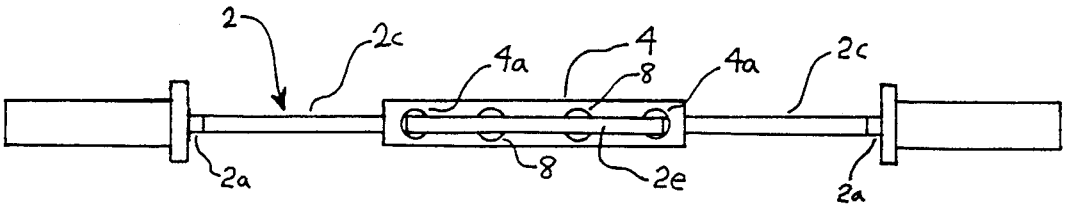
FIG. 1 is a top view of the embodiment referred to as the Power Bar as it appears before the weakpoint is reached.
Figure 2:
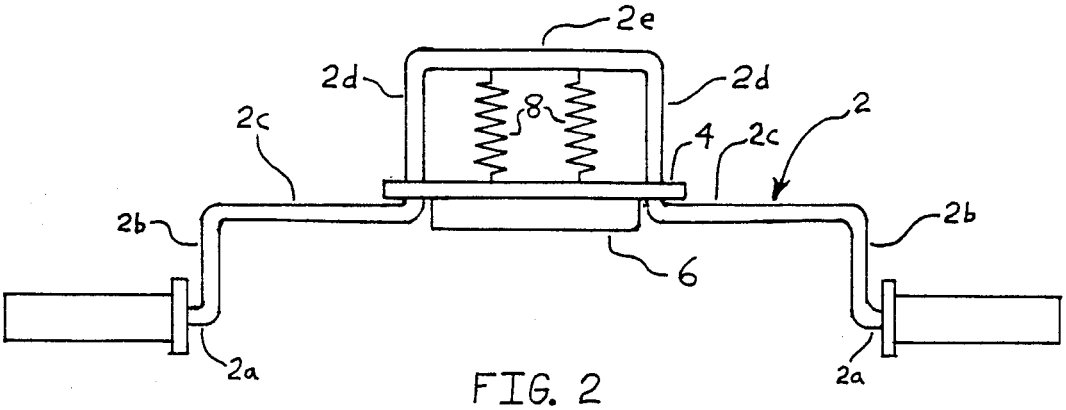
FIG. 2 is a front view of the Power Bar embodiment as it appears before the weakpoint is reached.

Like reference numerals apply to like parts throughout FIGS. 1 through 4. The Power Bar is made up, in part, of a bar of any shape, such as bar 2, which has two lower horizontal portions **2*a*, two lower vertical portions 2*b*, two middle horizontal portions 2*c*, two upper vertical portions 2*d*, and one upper horizontal portion 2*e*. The right end of the left lower horizontal portion 2*a* is connected to the lower end of the left vertical portion 2*b*, the upper end of the left lower vertical portion 2*b* is connected to the left end of the left middle horizontal portion 2*c*, the right end of the left middle horizontal portion 2*c* is connected to the lower end of the left upper vertical portion 2*d*, the upper end of the left upper vertical portion 2*d* is connected to the left end of the upper horizontal portion 2*e*, the right end of the upper horizontal portion 2*e* is connected to the upper end of the right upper vertical portion 2*d*, the lower end of the right upper vertical portion 2d is connected to the left end of the right middle horizontal portion 2c, the right end of the right middle horizontal portion 2c is connected to the upper end of the right lower vertical portion 2b, and the lower end of the right lower vertical portion 2b is connected to the left end of the right lower horizontal portion 2a, to form a single bar having two right angled steps in elevation on each side. The Power Bar is also made up, in part, of a member of any shape, such as plate 4 which is a rectangular hexahedron. The plate 4 is at least one millimeter longer than the upper horizontal portion 2e of the bar 2, and at least one millimeter wider than the width of the upper vertical portions 2d of the bar 2. The top surface of the plate 4 has two vertical circular holes 4a, each having a bore at least equal to the width of the upper vertical portions 2d of the bar 2, one located at each end of the plate 4, spaced the same distance apart as the upper vertical portions 2d of the bar 2. The plate 4 has padding 6 added to its lower horizontal surface. The left and right upper vertical portions 2d of the bar 2 pass, respectively, through the left and right holes 4a, so that the plate 4 is free to move only in the vertical direction and only between the upper and middle horizontal portions of the bar 2. The Power Bar is also made up of a means of creating a force between the bar and the moving member, such as the two compression springs 8, each of which is connected at one end to the upper horizontal portion 2e of the bar 2 and at the other end to the plate 4**.

Figure 3:
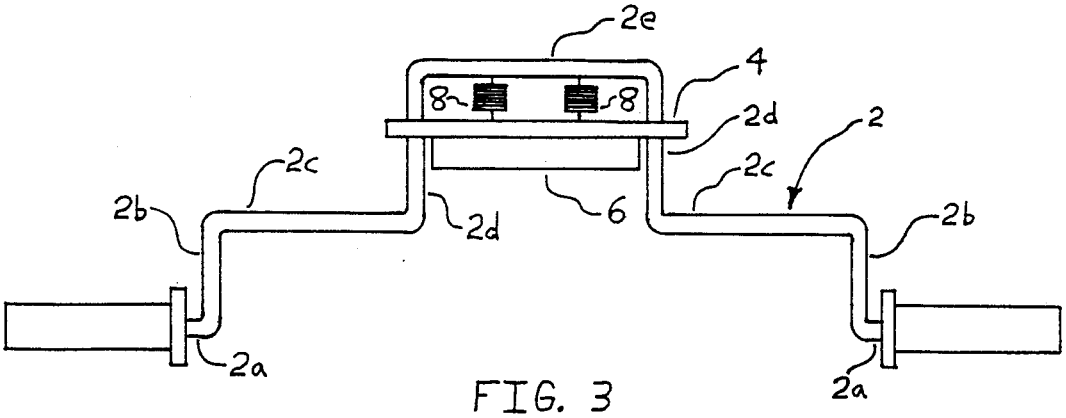
FIG. 3 is a front view of the Power Bar embodiment as it appears durin the weakpoint of the exercise stroke.
Figure 4:
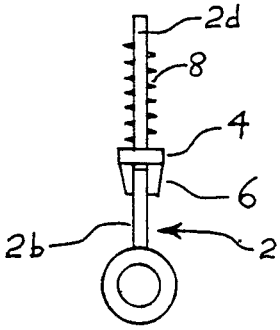
FIG. 4 is a side view of the Power Bar embodiment as it appears before the weakpoint is reached.

In use, weight plates are loaded onto the lower horizontal portions 2a of the bar 2. The weightlifter's hands are placed on the left and right middle horizontal portions 2c of the bar 2. The weightlifter then performs an exercise in which the bar 2 is brought toward the body and then pushed away from the body, e.g., bench press. When the weightlifter lowers the bar 2 to the weakpoint, padded surface 6 of plate 4 comes into contact with the weightlifter's body, preventing plate 4 from moving any further while bar 2 continues to move downward, thus compressing springs 8, as shown in FIG. 3. As springs 8 are compressed, they exert an upward force on bar 2, thus decreasing the load on the weightlifter's muscles and allowing the weightlifter to lift a heavier weight through the weakpoint than would be possible without the Power Bar. The force exerted by the Power Bar can be varied by varying the number and/or coeficient of elasticity of the springs 8. The portion of the exercise stroke through which the weightlifter is assisted by the Power Bar can be varied by varying the height of the upper vertical portions 2d of the bar 2 and/or by varying the height of the padding 6.

Figure 5:
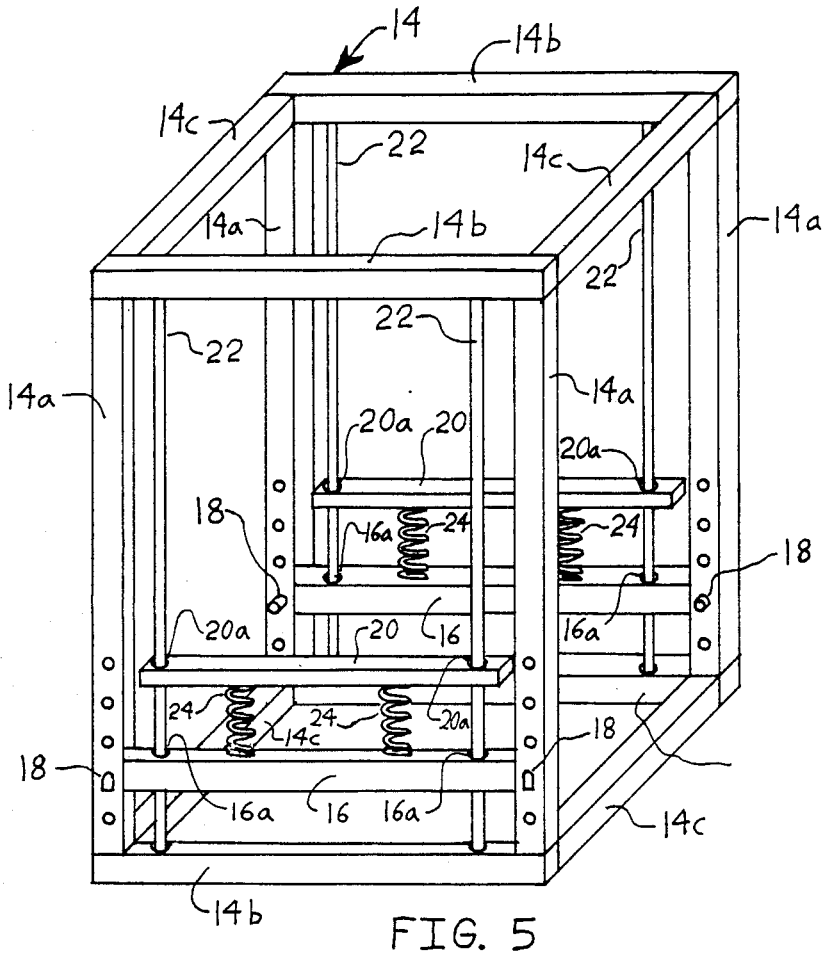
FIG. 5 is a perspective view of the embodiment referred to as the Power Cage as it appears at the beginning of the exercise motion.
Figure 6:
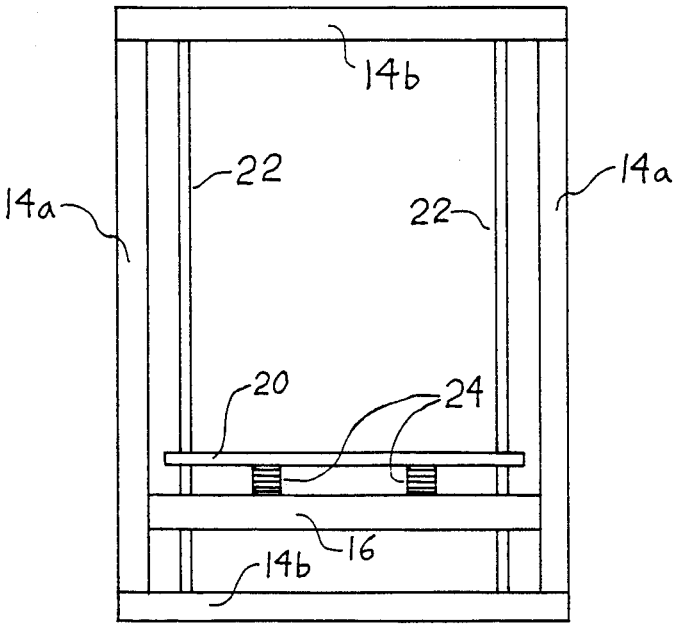
FIG. 6 is a side view of the Power Cage embodiment as it appears during the lower portion of the exercise motion.

FIGS. 5 and 6 show a second form of this invention, which will be referred to as the Power Cage. Like numerals apply to like parts throughout FIGS. 5 and 6.

The Power Cage is comprised of:

(1) a support structure, such as metal rectangular hexahedron 14, comprised of: four vertical support beams 14a, four front and back support beams 14b, and four side support beams 14c, 11 of sufficient length so that the weightlifter can stand inside the support structure;

(2) means of adjusting the height through which the weightlifter receives assistance, such as the two lower adjustable beams 16, one located on each side of the Power Cage, and each having two vertical appertures 16a, and a means of adjusting the height of the lower beams 16 such as bolts 18 which pass through holes in the vertical support beams 14a to lock the lower adjustable beams 16 into place;

(3) means of transferring force to the free-weights, such as the two upper moveable beams 20, one located on each side of the Power Cage above the lower adjustable beams 16, and each having two vertical appertures 20a spaced the same distance apart as the appertures 16a in the lower adjustable beams 16, and four vertical guide bars 22, two located on each side of the Power Cage, spaced the same distance apart as appertures 16a and 20a, and passing through appertures 16a and 20a so that upper moveable beams 20 and lower adjustable beams 16 can move only in the vertical direction; and (4) at least one means of creating force, such as the four compression springs 24, two located on each side of the Power Cage, and each connected at its upper end to the corresponding upper moveable beam 20 and at its lower end to the corresponding lower adjustable.

In use, the lower adjustable beams 16 are raised to the desired level and locked into place by the use of bolts 18. The weightlifter then positions himself within the Power Cage with the weight bar above the upper moveable beams 20 and positioned so that the left and right ends of the weight bar overhang the left and right upper moveable beams 20. The weightlifter then begins the exercise stroke. During the first portion of the exercise stroke the weight bar is above the upper moveable beams 20 and therefore the weightlifter is not assisted by the Power Cage. As the weight bar is further lowered, it comes into contact with the upper moveable beams 20, which are forced downward. As the upper moveable beams move downward, the compression springs 24 are compressed and exert an upward force on the upper moveable beams 20, which, in turn, exert an upward force on the weight bar thereby assisting the weightlifter in lifting the weight bar through that lower portion of the exercise stroke.

Of course many other forms of this invention are possible, and the forms described above are given by way of example only, and are not meant to limit the scope of this invention in any way or manner. For instance, the means of creating force can be: springs, or any material or device which creates a resistant force when displaced from its natural dimensions; gas, hydraulic or other pistons; counterweights attached to the free-weights with pulleys and cables or ropes; or any other means of creating an upward force on the weight bar during a portion of the exercise stroke. One example would be a tension spring with one end connected to a support structure, like a ceiling beam, and the other end connected to a rope or cable. The rope or cable is then connected to the free-weight bar and its length adjusted so that it is slack throughout the strongpoint but becomes taut when the weakpoint is reached. When the free-weight bar is lowered beyond the point where the rope or cable becomes taut, the tension spring is forced to expand, generating a resistant upward force on the free-weights. A variant of this example would be a rope connected to the free-weight bar at one end, passing over a pulley located above the free-weight bar and connected at its other end to a counterweight. The length of the rope is then adjusted in such a manner that it is slack through the strongpoint but taut through the weakpoint, so that the counterweight is lifted through the weakpoint, thereby creating an upward force on the free-weights.

I claim:

1. A free weight exercise device comprising: a free weight bar, said bar having an upper generally horizontal portion, a pair of generally vertical portions extending in the same general direction from the ends of said upper horizontal portion, a pair of lower generally horizontal portions extending from the ends of said vertical portions, and a pair of weight receiving portions on the ends of said lower horizontal portions, said upper horizontal portion, vertical portions, lower horizontal portions and weight receiving portions being generally coplanar; a plate slidably mounted on and extending between said vertical portions; and, means for biasing said plate away from said upper horizontal portion.

2. A free weight bar as defined in claim 1 wherein said plate is padded.

3. A free weight bar as defined in claim 1 wherein said biasing means includes at least one compression spring.

* * * * *